United States Patent [19]

Cushing

[11] 4,175,575

[45] Nov. 27, 1979

[54] DISHWASHER WITH OSCILLATING ROTARY SPRAY ARM

[75] Inventor: Donald S. Cushing, Louisville, Ky.

[73] Assignee: General Electric Company, Louisville, Ky.

[21] Appl. No.: 890,428

[22] Filed: Mar. 27, 1978

[51] Int. Cl.[2] ..... B08B 3/02

[52] U.S. Cl. ..... 134/176; 134/180; 239/255

[58] Field of Search ..... 134/176, 179, 180–181; 239/255

[56] References Cited

U.S. PATENT DOCUMENTS

| | | | |
|---|---|---|---|
| 1,223,380 | 4/1917 | Garis-Cochrane | 134/176 X |
| 1,408,077 | 2/1922 | Clinton | 134/179 UX |
| 2,021,962 | 11/1935 | Marsh, Jr. | 134/179 |
| 2,960,990 | 11/1960 | Jones et al. | 134/176 X |
| 3,361,361 | 1/1968 | Schutte | 134/179 X |
| 3,538,927 | 11/1970 | Wallgren | 134/176 X |
| 3,642,208 | 2/1972 | Guth | 239/255 |
| 4,013,222 | 3/1977 | Travaglio | 239/255 X |

*Primary Examiner*—Robert L. Bleutge

*Attorney, Agent, or Firm*—H. Neil Houser; Radford M. Reams

[57] ABSTRACT

An arrangement for oscillating a rotating dishwasher spray arm about its longitudinal axis to direct the jet sprays at the dishware items at various differing angles including forward, reverse and vertical inclinations to increase coverage and to improve the jet spray washing action by reducing shadowing. The oscillation is produced by a drive gear and crank mechanism driven by a fixed reaction gear as the spray arm rotates. Jet reaction forces are utilized to rotate the spray arm and are related with respect to the axis of rotation of the spray arm so that the resultant torque causing rotation of the spray arm does not significantly vary as the spray arm is oscillated to insure the proper rotational speed of the spray arm. The frequency of oscillation relative to the frequency of rotation is selected to be such that a number of differing jet spray angles are produced for each rotational position of the spray arm in successive revolutions thereof to minimize shadowing effects. Particular mounting details for the spray arm accommodate the simultaneous rotation and oscillation and allow the supply of washing liquid via the mounting structure.

19 Claims, 4 Drawing Figures

DISHWASHER WITH OSCILLATING ROTARY SPRAY ARM

BACKGROUND DISCUSSION

Modern dishwashers typically incorporate a spray arm located in the lower region of the interior space of the dishwasher cabinet, which arm is rotated as by water jet reaction forces while rotating a plurality of washing jet sprays directed at the dishware items by directing a washing liquid under pressure through nozzle openings formed along the length of the spray arm. In order to wash both the front and back of items such as plates, which typically are racked so as to lean back, forwardly and reversely angled jet sprays have been utilized in addition to vertical jets, but this requires additional pump flow in order to achieve total coverage of the dishware items.

Also, in using fixed angle jet sprays, a certain amount of shadowing of the jet spray may occur at each rotational position of the spray arm. That is, portions of the jet sprays may be intercepted by dishware surfaces before impingement on dishware surfaces positioned remotely therefrom, as viewed along the direction of the jet spray.

It has heretofore been proposed to oscillate or rotate the spray arm about its longitudinal axis as the spray arm rotates about a central transverse axis to thereby vary the angle of the jet sprays as the dishwasher spray arm rotates.

The oscillation has been described as being carried out by means of a jet reaction wheel, positioned within a housing which receives water under pressure from the circulation pump and directed in a jet at the reaction wheel to cause the reaction wheel to rotate. The rotation of the reaction wheel in turn produces oscillation of the dishwasher spray arm about its longitudinal axis by a gear driven crank mechanism. The forces producing rotation of the spray arm about its central transverse axis are produced by a difference in reactions of jet sprays on either side of the spray arm on opposite sides of the rotational axis. Accordingly, as the spray arm oscillates in one direction, the asymmetrical arrangement of the reaction jets on one side could cause changes in the differential forces acting on the spray arm during oscillation such that the torque acting on the spray arm may vary as the oscillation of the spray arm takes place. The result is a variation in rotational speed of the spray arm which cannot therefore rotate at a single optimal rate at which the best washing action is achieved.

In addition, this requires two different sets of jets for washing the front and rear of dishes to thus increase the flow requirements of the pump supplying the washing jets.

Also, the use of a submerged reaction wheel and gearing around which is circulated wash water bearing solids washed from the dishes may lead to less than reliable operation since jamming of the gears from accumulated solids would be likely.

In another arrangement which has been proposed, the spray arm is described as being caused to rotate by means of a fixed reaction gear cooperating with a gear carried on the spray arm, which is mounted for rotation about its longitudinal axis as well as about its central transverse axis. As the spray arm rotates, the fixed reaction gear causes rotation of the spray arm about its longitudinal axis. In this arrangement, the spray arm is required to have diametrically opposite jet pairs which serve to balance the torque in all positions of the rotary spray arm about its longitudinal axis, such that the rotation thereof does not produce a variation in torque. However, this necessitates that one end of the spray arm cannot be rotated since one end of the spray arm is required to produce the jet reaction forces necessary in order to impart rotation of the spray arm as a whole. In addition, a 360° rotation of the spray arm obviously is not suited to bottom-mounted spray arms as the jet sprays must be directed generally upwardly in order to contact the dishware.

It can be appreciated that the above-mentioned desirability of a varied attitude of the washing jet sprays to produce maximum coverage of a single set of jet nozzles, and to prevent shadowing applies to each rotational position of the spray arm. That is, a variation in jet angle at every rotational position will increase the coverage and reduce the degree of shadowing which will occur with the spray arm in that position. Neither of the above-mentioned proposals describe an arrangement for accomplishing this result.

In addition, any such design feature should desirably not introduce undue complexity to the dishwasher and should operate reliably since the manufacturing costs and consumer acceptance of such products are of considerable importance in their design.

Accordingly, it is an object of the present invention to provide an arrangement for producing oscillation of the rotary spray arm about its longitudinal axis so as to cause a varying washing jet spray attitude with respect to the dishware as the spray arm rotates such that each jet spray is directed in a forward, reverse and vertical inclination with respect to the dishware.

It is still another object of the present invention to provide such an arrangement in which the oscillation does not result in a variation in jet reaction forces on the spray arm tending to produce varying rates of rotation thereof, and which allows the entire length of the spray arm to be oscillated.

It is a further object of the present invention to provide such an arrangement in which a number of jet spray angles with respect to the dishware items are achieved in each rotational position of the spray arm.

It is another object of the present invention to provide such features with a simple and reliable design of the spray arm and mounting structure.

SUMMARY OF THE INVENTION

These and other objects of the present invention, which will become apparent upon a reading of the following specification and claims, are accomplished by a drive for continuously oscillating a rotary spray arm so that a single series of jet sprays are directed at the dishware in a forward and reverse inclination, as well as vertically to maximize coverage. This oscillation is achieved in response to rotation of the spray arm, the drive including a gear and crank mechanism driven by a fixed reaction gear which mechanism causes oscillation of the spray arm about its longitudinal axis. The jet reaction forces generating the rotational movement of the spray arm are produced by symmetrically arranged jet nozzles arranged on either side of the axis of rotation which direct the jet sprays at equal but opposite inclinations to the longitudinal axis of the spray arm when the arm is in the neutral position. The reaction forces on either side of the axis of rotation are equal but oppositely directed in the neutral position of the spray arm by providing oppositely directed reaction jet nozzle openings in the spray arm. The excursions caused by oscillations do not result in variations in torque as the spray arm undergoes oscillation since increases in inclination with respect to the longitudinal axis of one of the reaction jets are inherently accompanied by a corresponding decrease in inclination of the other.

The frequency of oscillation is a non-integer multiple of the frequency of rotation of the spray arm such that the washing jet sprays are directed at the dishware items at a number of differing angles in each rotary spray position of the spray arm.

The gear-crank mechanism comprises a drive gear to which is pivotally joined at one end a connector link eccentrically located with respect to the axis of rotation of the drive gear, and the other end of which is joined to a fixed arm secured to the spray arm. The drive gear is rotated by a fixed reaction gear engaging the drive gear such that rotation thereof produces oscillation of the spray arm by movement of the connector link.

DETAILED DESCRIPTION

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations with the scope of the appended claims.

Figure 1:
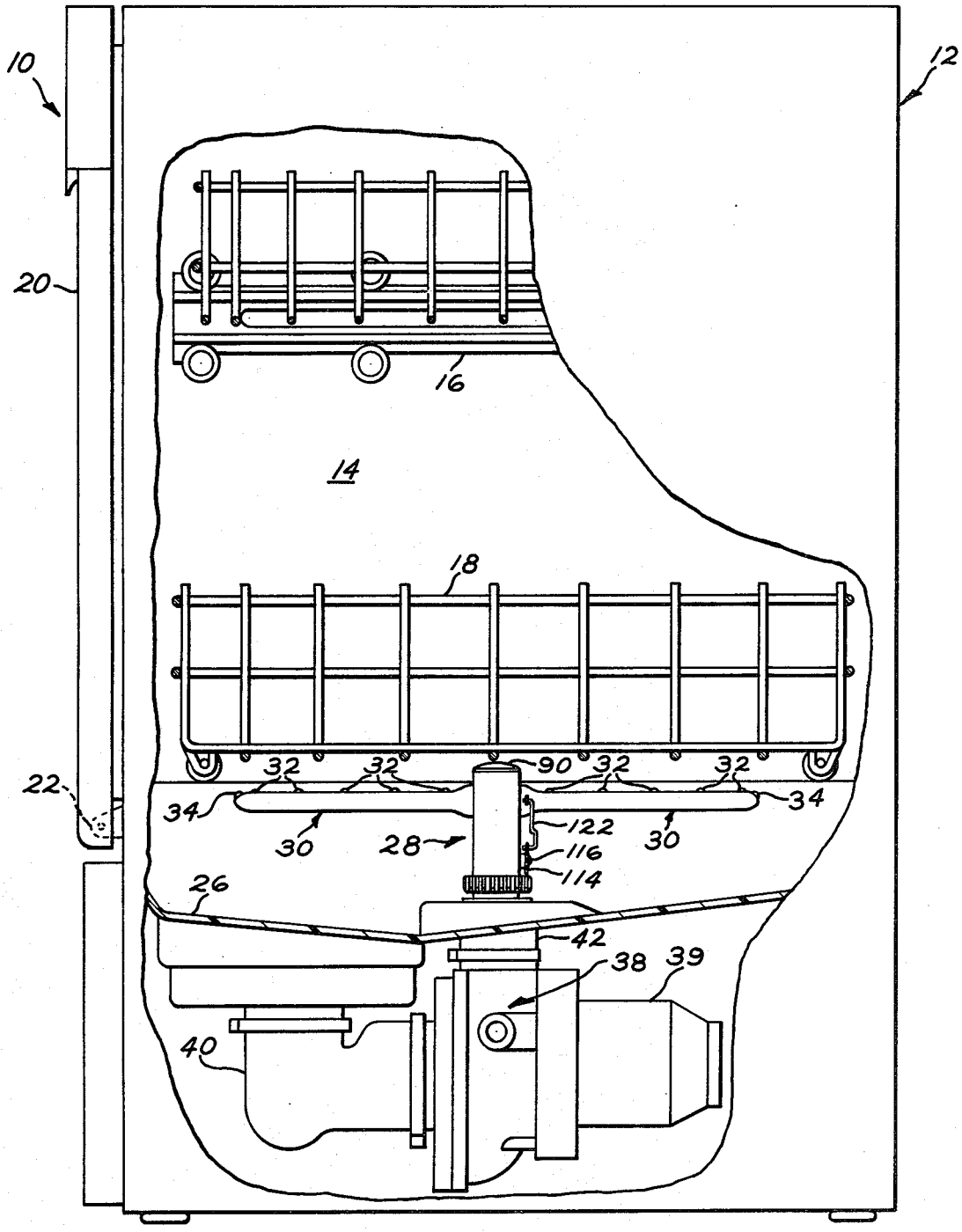
FIG. 1 is a side elevational view of a dishwasher incorporating the spray arm oscillation arrangement according to the present invention, portions of the exterior cabinet broken away to illustrate the installation of the spray arm.

Referring then to the drawings and particularly to FIG. 1, the dishwasher 10, incorporating the arrangement of the present invention, includes the conventional arrangement of the dishwasher cabinet 12 which defines lined interior space 14. The interior space 14 is provided with an upper rack 16 and a lower rack 18 for positioning items of dishware to be washed therein. The dishwasher cabinet 12 includes a dishwasher access door 20 which is hinged at 22 to provide access to the interior space 14. The upper rack 16 and lower rack 18 are mounted on rollers as shown to allow the upper rack 16 and lower rack 18 to be moved out of the interior space 14 for loading purposes.

The lower region 24 of the interior space 14 is defined in part by a bottom tub 26 which is adapted to collect the cleaning liquid, i.e., water, after it has been directed at the dishware items in washing jet sprays. In order to generate the jet sprays, there is provided a bottom-mounted dishwasher spray arm assembly 28 which is rotatably mounted in the interior space 14. The dishwasher spray arm assembly 28 includes a spray arm 30 comprised of an elongated member having an interior hollow space which is provided with the cleaning liquid wash water under pressure and which is directed through a plurality of nozzles 32 formed along the longitudinal length of the spray arm 30. The nozzles 32 are positioned such that the water will egress in upwardly directed jet sprays to thereby provide the means for washing the dishware items disposed in the upper rack 16 and lower rack 18.

The spray arm 30 is rotatably mounted as noted and is caused to rotate about an axis of rotation extending transversely to the longitudinal axis of the spray arm 30 and at a point centrally located of the length thereof. This rotation is induced by a pair of reaction jet nozzles 34 located at opposite ends of the spray arm 30. Each of the reaction jet nozzles 34 is provided with an oppositely directed nozzle opening 36 (FIG. 2) of such size as to create equal but oppositely directed reaction forces upon egress of a liquid in a jet spray such as to produce a torque acting on the spray arm 30 causing it to rotate about its central transverse axis. The nozzle openings 36 are also inclined with respect to the longitudinal axis of the spray arm at equal but opposite angles when the spray arm is in the neutral position shown in FIG. 3. The significance of the balanced reaction forces and the inclination of the reaction jets will be described hereinafter with respect to the oscillation of the spray arm 30 which takes place as the spray arm 30 rotates about a central transverse axis.

The dishwasher 10 is also provided with a circulating pump 38 driven by a drive motor 39 in which the cleaning liquid collected in the tub 26 is directed to the inlet of the circulating pump 38 via inlet connection 40 with an outlet connection 42 provided which supplies the interior of the spray arm 30 with the pressurized cleaning liquid through interior spaces provided in the various mounting components.

Figure 2:
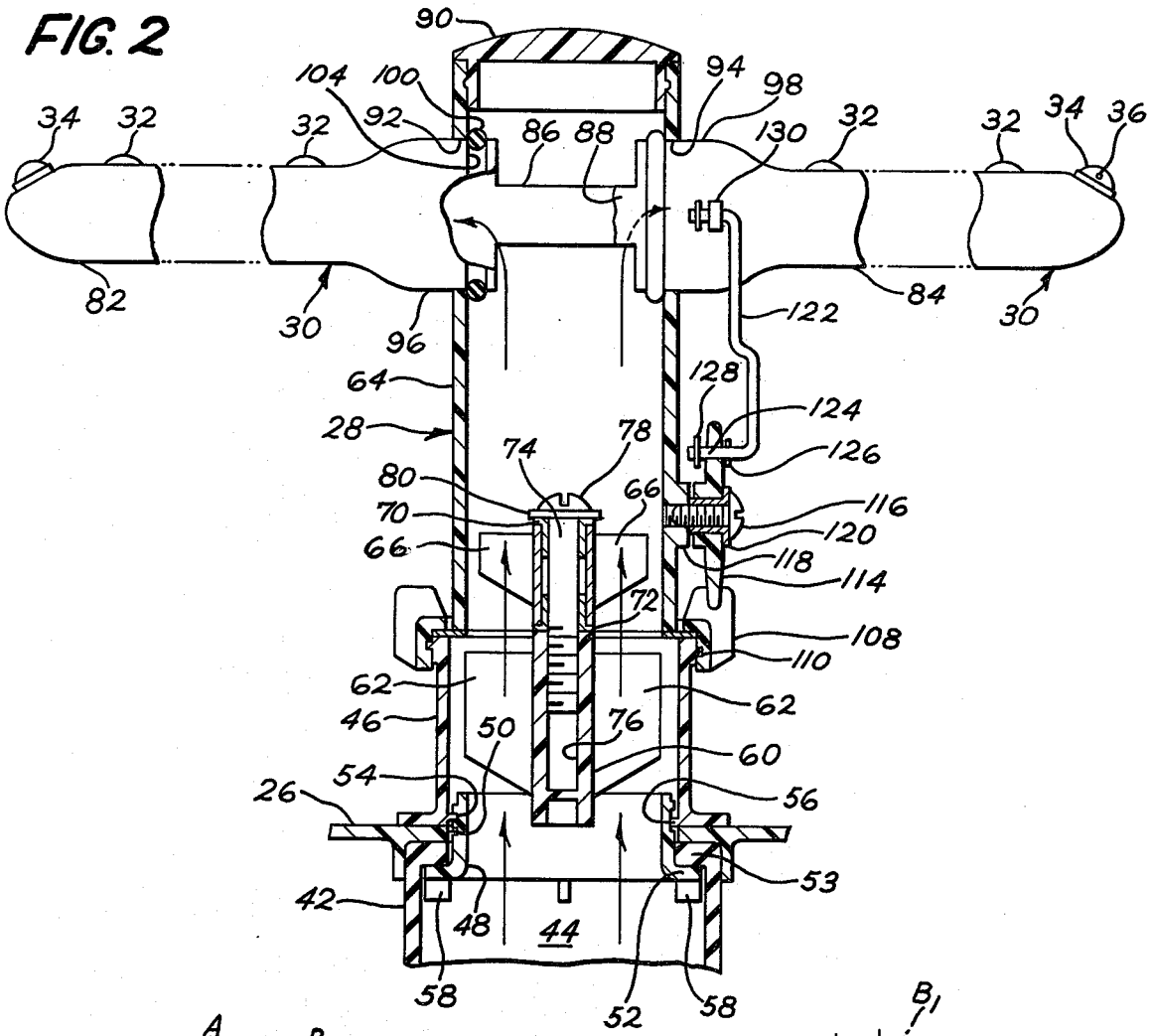
FIG. 2 is a fragmentary and partially sectional view of a spray arm and mounting arrangement thereof depicting the oscillation drive mechanism according to the present invention.
Figure 3:
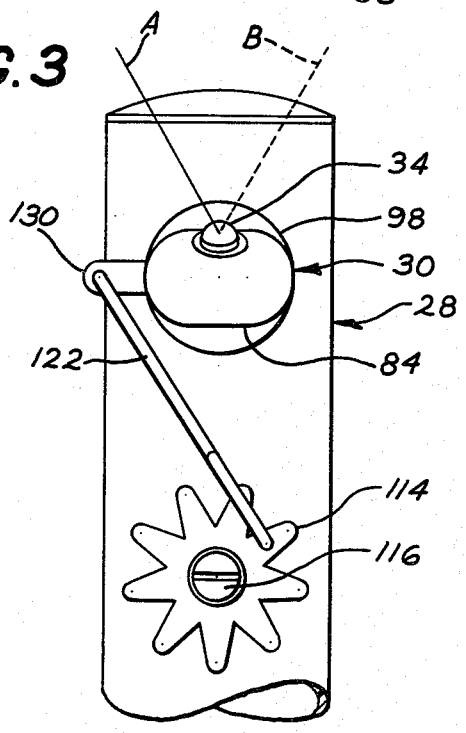
FIG. 3 is a fragmentary endwise elevational view of the spray arm and drive arrangement shown in FIG. 2.

The mounting arrangement is illustrated in FIG. 2 in which a portion of the outlet connection 42 is shown, having an interior spaced 44 in communication with the interior of a support tube 46. Both the outlet connection 42 and the support tube 46 are secured to the bottom of tub 26 by means of a threaded collar 48 received within the interior of the outlet connection 42 and support tube 46 and an opening 50 extending through the bottom of tub 26. The threaded collar 48 is formed with a flange 52 seating on an inwardly turned flange 53 formed on the outlet connection 42 with an external thread 54 formed on the threaded collar 48 engaging an external thread 54 such as to secure a corresponding threaded section formed on the inside diameter of the pedestal support tube 46, such as to secure the pedestal support tube 46 and the outlet connection 42 to the bottom of tub 26 as shown in FIG. 3.

Drive tabs 58 are provided on the threaded collar 48 in order to enable rotation of the same to bring the external thread 54 and threaded section 56 into engagement in installing and assembling the unit.

As described above, the dishwasher spray arm assembly 28 includes means to mount the spray arm 30 for rotation about an axis transverse to the longitudinal axis of the spray arm 30. This means includes a stationary central hub 60 which is supported by means of a plurality of vane supports 62 extending radially outward from the central hub 60 and fixed at their outboard ends to the inside diameter of the pedestal support tube 46. The hub 60 is formed with an axially extending bore 76 which provides a rotary support for a hub tube 64 in concentric alignment with both the outlet connection 42 and the pedestal support tube 46. This support is provided by a rotary hub 68 affixed to the hub tube 64 by a plurality of support vanes 66, each of which extend radially outwardly from the rotational axis to the interior of the hub tube 64 and being affixed at the inboard ends thereof to the rotary hub 68. The rotary hub 68 is thus fixed to the hub tube 64. An axle shaft 74 is positioned within bearings 70 and 72 mounted within the rotary hub 68 which extends into the bore 76 so as to rotatably mount the hub tube 64 on the central hub 60. Bearings 70 and 72 are secured with a machine screw 78 threaded into the end of the axle shaft 74 and thrust washer 80.

The hub tube 64 receives the spray arm 30 which extends through the hub tube 64 with its longitudinal axis extending transversely to the axis of rotation thereof, such that the spray arm 30 has a pair of opposite ends 82 and 84 located on either side of the axis of rotation.

The spray arm 30 is shown with the opposite ends 82 and 84 being of integral construction, joined by a pair of webs 86 and 88 such that the spray arm 30 is of a one-piece construction so that the entire spray arm 30 will be oscillated as a unit with a single drive described below. This also allows the interior of the spray arm ends 82 and 84 to receive the cleaning liquid under pressure through the interior of the hub tube 64, so as to be directed to the washing jet nozzles 32 and the reaction jet nozzles 34. An end cap 90 is provided to seal the end of the hub tube 64.

The spray arm 30 is rotatably mounted with respect to the hub tube 64 by being received in bores 92 and 94 with the section of the spray arm 30 being round in section such as to mate rotatably with the sections 96 and 98 of either ends 82 or 84 being of circular cross sectional shape such as to be rotatably mated with respect to the bores 92 and 94 formed in the hub tube 64.

A pair of O-rings 100 and 102 are respectively seated in grooves 104 and 106 to provide both a fluid seal for the bores 92 and 94 and also to axially locate the spray arm 30 within its mounting to the hub tube 64. This thus rotatably mounts the spray arm 30 at a point intermediate its length thereof for oscillation about its longitudinal axis.

This rotational mounting accommodates oscillatory movement which is impressed on the spray arm 30 as the spray arm 30 rotates the dishwasher spray arm assembly 28 about its central transverse axis. This oscillation is carried out by drive means operated by rotation of the spray arm 30.

This drive means includes a fixed reaction gear 108 which is mounted to the pedestal support tube 46 by virtue of a threaded connection 110. The fixed reaction gear 108 is mounted concentrically to the central transverse axis about which the dishwasher spray arm assembly 28 rotates. This also serves to mount a lip seal 112 which extends radially inwardly and contacts the end face of the hub tube 64 such that upon pressurization thereof, an axial sealing engagement therebetween is established to prevent leakage of the cleaning liquid directed into the interior of the hub tube 64 to cause the hub tube 64 and spray arm 30 to be rotatably connected.

Drivingly engaging the fixed reaction gear 108 is a driving gear 114 which is mounted to the hub tube 64 for rotation about an axis transverse to the axis of the fixed reaction gear 108. This mounting is by means of an axle screw 116 threadably received into a boss 118 formed on the sidewall of the hub tube 64. A thrust bearing 120 rotatably mounts the driving gear 114 about the axis. As the hub tube 64 rotates about the central transverse axis of the spray arm 30, the driving gear 114 is thus caused to be rotated about its axis.

This rotation is caused to produce continuous oscillation of the spray arm 30 during such rotation by a driving connection including a connecting link 122 which has one end thereof pivotally mounted with respect to the driving gear 114 at a point eccentrically offset from the axis of rotation thereof, as indicated, by having its end 124 passing through an opening in the driving gear 114 with suitable retainers 126 and 128 insuring the retention of the end 124 therein. The connecting link 122 is pivotally connected at its other end to the spray arm 30 by means of a crank arm 130 which is affixed to the exterior of the opposite side 84.

Thus, as the driving gear 114 rotates, the movement of the connecting link 122 produces oscillatory movement of the spray arm 30 about its longitudinal axis. Such oscillatory movement is induced by means of rotation of the dishwasher spray arm assembly 28 created by the reaction torque generated by the reaction jet nozzles 34. This oscillatory movement is as indicated in FIG. 4.

FIG. 3 shows the relationship of the angles of the reaction jet nozzles 34 on either end 82 and 84. The line A indicates the angle of the reaction jet nozzle 34 associated with the spray arm end 82, while the dotted line B indicates the angle of the reaction jet nozzle 34 associated with the spray arm opposite end 84. While these are generally inclined with respect to the longitudinal axis of the spray arm 30 to direct the jet sprays upwardly, they have a component transverse to the central transverse axis about which the spray arm 30 is mounted for rotation such that oppositely directed reaction forces produced by the jet spray egressing therethrough produce a torque acting on the dishwasher spray arm assembly 28 such as to cause rotation.

According to the concept of the present invention, the reaction jet nozzles 34 are directed to be of the same size and also at an opposite but equal inclination with respect to the central transverse axis when the spray arm 30 is in its centered or neutral position, such that equal but oppositely directed reaction forces are impressed on either opposite end 82 or 84 tending to produce rotation cooperatively.

Figure 4:
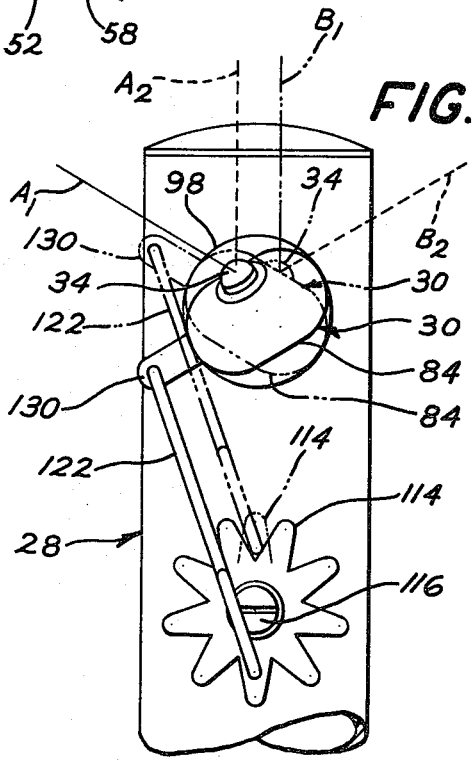
FIG. 4 is an endwise view of the spray arm and drive arrangement shown in FIG. 3, depicting the oscillatory movement in opposite extreme positions thereof occurring as rotation of the spray arm takes place.

It can be seen that as the oscillation takes place clockwise as viewed in FIG. 4, the extreme of position indicated by the lines A1 to A2, and B1 to B2, each of the torque producing components of the respective reaction jet nozzles associated with either end portion of the spray arm 30 changes, but the changes are offsetting. That is, as the inclination of one of the jet spray angles changes such as to increase the torque component exerted on the dishwasher spray arm assembly 28 as a whole, there is an offsetting decrease due to the decreasing inclination of the reaction jet nozzle on the opposite arm, both being measured in a plane normal to the longitudinal axis. The washing jet nozzles 32 assume a vertical position at the neutral point of the oscillation and are inclined forwardly and reversely at each position. Since the washing jets on either side of the spray arm 30 oppose the torque generated by the other, changes in jet reaction forces during oscillation are thereby counteracted to maintain a net torque of zero acting on the spray arm 30.

Thus, the torque exerted on the dishwasher spray arm assembly 28 remains substantially constant and the jet reaction forces can be designed for the optimal spray arm speed to produce optimum washing action which will not substantially vary as the spray arm 30 oscillates.

It should be noted that this offsetting change relationship is most easily achieved by limiting the angle through which the spray arm 30 is oscillated to be less than the angle between the direction of reaction jets on either end 82 or 84 of the spray arm 30 measured in a plane normal to the longitudinal axis, and that the angle so measured be less than 180° apart.

An important feature is the relationship between the ratios of the drive means frequency of oscillating the spray arm 30 with the rotational frequency of the dishwasher spray arm assembly 28. In order to achieve a minimal shadowing, the drive means includes means causing a non repeat of the oscillatory position of the spray arm in a given rotational position for at least several, i.e., three successive, revolutions of the spray arm. In the embodiment shown, the oscillation rate produced is a non-integer multiple of the rotation rate such that a minimum of three to five revolutions of the spray arm 30 take place before there is a repeat in the spray arm inclination in a given rotational position. Preferably, there should be a much greater number of revolutions on the order of twenty revolutions of the spray arm 30 before repeat.

Accordingly, for each rotational position of the spray arm 30 about its central transverse axis of rotation, there is achieved a number of differing jet spray angles with respect to the dishware items to thereby greatly increase the coverage of a single row of jet nozzles and reduce the incidence of shadowing of the dishware and rack surfaces in each rotary position of the spray arm 30.

This also achieves the end result that a single series of washing jet nozzles 32 provides both reversely and forwardly inclined jet sprays to afford coverage on either side of leaning dishware items.

It can further be seen that the direct mechanical drive produces a positive relationship of the frequency of oscillation as distinguished from the use of a reaction wheel in which the fluid dynamic forces determine the rate of oscillation which may vary such that any particular frequency relationship may not be maintained between the spray arm oscillation and rotation.

Accordingly, this arrangement provides a bottom-mounted rotary spray arm which is oscillated in such a way that the rotational rate of the spray arm is not affected during the course of the oscillation since the rotation inducing jet reaction component created by the reaction jets remains substantially constant through the excursions of the spray arm 30 oscillator.

The particular driving mechanism disclosed for producing oscillation is relatively simple, being composed of a small number of parts, which parts in themselves are of simple configuration such as to be low in cost to manufacture and reliable in operation.

The mounting arrangement for the spray arms is such as to afford this simultaneous oscillation and rotation and is likewise simple in keeping with the usual design objectives in mass-produced appliances such as dishwashers.

Many variations of the arrangement depicted are of course possible within the scope of the present invention as in the specific driving arrangement. While the disclosed design is particularly advantageous, there are other such mechanisms with which to achieve the driving relationship to produce a simultaneous oscillation and rotation thereof.

The particular details of mounting and configuration of the various components are of course susceptible of variation, as for example, the making of the spray arm in two separate pieces wherein a connecting coupling insures that both end portions of the spray arm 30 rotate together while allowing communication to the interior space thereof.

The specific relationship of the frequency of rotation to the frequency of oscillation may be varied depending on the particular dishwasher design into which the unit is incorporated.

The embodiments of the invention in which an exclusive property or privilege is claimed are defined as follows:

1. A dishwasher including a dishwasher cabinet having an interior space provided therein; rack means for positioning dishware items within said cabinet interior space; and means for directing jet sprays of cleaning liquid at said items of dishware, said means including:

a spray arm comprised of an elongated hollow member;

means rotatably mounting said spray arm within said cabinet interior space for rotation about a central axis transverse to the longitudinal axis of said spray arm;

means for causing said cleaning liquid to be circulated under pressure into the interior of said spray arm;

a plurality of jet spray openings formed along the length of said spray arm on either side of the axis of rotation thereof;

whereby said cleaning liquid passes under pressure out through said jet spray openings to direct washing jet sprays at said dishware items;

means for causing said spray arm to continuously rotate in a single direction about said central transverse axis whenever said cleaning liquid is circulated into said spray arm;

means for producing oscillation of said spray arm about its longitudinal axis, said means including drive means responsive to said rotation of said spray arm about said central transverse axis to continuously oscillate said spray arm about said longitudinal axis;

whereby said spray arm is oscillated by said rotation of said spray arm about said central axis.

2. The dishwasher according to claim 1 wherein said means causing said rotation of said spray arm includes means producing jet sprays from either end of said spray arm, said jet sprays each directed at an inclined angle with respect to said longitudinal axis in generally opposite directions, and each having a component thereof producing a torque acting on said spray arm tending to produce rotation thereof about said central transverse axis.

3. The dishwasher according to claim 2 wherein the angle between said reaction jets measured in a plane normal to said longitudinal axis is at least as great as the angle through which said spray arm is oscillated.

4. The dishwasher according to claim 3 wherein each of said reaction jet sprays produces an equal torque component when said spray arm is in the neutral position in said oscillation thereof.

5. The dishwasher according to claim 3 wherein said drive means producing oscillation of said spray arm further includes a connecting link pivotally mounted to said drive gear at a point offset from said drive gear axis of rotation and further including means drivingly connecting the other end of said connecting link to said spray arm, whereby rotation of said drive gear produces said oscillation by movement of said connecting link.

6. The dishwasher according to claim 5 wherein said means drivingly connecting said connecting link of said spray arm includes a crank member affixed to said spray arm and means pivotally connecting said other end of said connecting link to said crank member.

7. The dishwasher according to claim 3 wherein said drive means producing oscillation of said spray arm further includes a hub tube aligned with said transverse central axis of rotation of said spray arm and means rotatably mounting said hub tube in said cabinet interior space for rotation about said central transverse axis, and further includes means rotatably mounting said spray arm to said hub tube with said spray arm extending transversely to said hub axis and said spray arm extending transversely to said hub axis and wherein said drive means includes means for oscillating said spray arm about said rotatable mount of said spray arm on said hub tube.

8. The dishwasher according to claim 7 wherein said means rotatably mounting said hub includes a fixed pedestal support tube and means rotatably mounting said hub tube concentrically on said fixed pedestal support tube and wherein said drive means includes a reaction gear fixed to and concentrically aligned with said fixed pedestal support tube.

9. The dishwasher according to claim 8 wherein said drive means further includes a rotatable drive gear and means mounting said drive gear including means mounting said drive gear to said hub tube for rotation about an axis extending transversely to said hub tube axis and in driving engagement with said fixed reaction gear whereby said drive gear is rotated by rotational movement of said hub tube about said central transverse axis, and further including means producing said oscillation of said spray arm in response to said rotation of said drive gear.

10. The dishwasher according to claim 9 wherein said drive means further includes a connecting link having one end pivotally mounted to said drive gear at a point offset from said drive gear rotational axis and further including means pivotally connecting said opposite end of said spray arm of said link with said spray arm, whereby said rotation of said drive gear and movement of said connecting link produces said oscillation of said spray arm.

11. The dishwasher according to claim 8 wherein said means supplying cleaning liquid to the interior of said spray arm and comprised by the interior of said hub tube further includes means producing fluid communication of the interior of said spray arm by means of an opening formed in said spray arm at a point thereof intermediate said spray arm portion disposed within said hub tube.

12. The dishwasher according to claim 8 wherein said means rotatably mounting said hub tube about said central transverse axis includes an axle shaft extending within the interior of said hub tube and said fixed pedestal support tube and said hub shaft, and means mounting said hub shaft within said fixed support tube including a plurality of radially extending vane members affixed to the exterior of said hub shaft and the interior of said fixed support tube, and further including a hub rotatably mounted on said hub shaft and drivingly connected to said hub tube by means of a plurality of radially extending vanes affixed to the exterior of said hub bearing and the interior of said hub tube, whereby said hub tube is rotatably mounted on said axle shaft and said hub tube is rotationally mounted with respect to said fixed pedestal support tube while being positioned concentrically with respect to said axis of said fixed pedestal support tube.

13. The dishwasher according to claim 1 wherein said drive means producing oscillation of said spray arm consists of a fixed reaction gear and further includes a drive gear carried by and rotated with said spray arm in engagement with said fixed reaction gear and further including means producing oscillation of said spray arm in response to rotation of said drive gear.

14. The dishwasher according to claim 1 wherein said drive means producing said oscillation of said spray arm about said longitudinal axis includes means causing said spray arm to assume non-repeating positions in each rotational position in successive revolutions of said spray arm.

15. The dishwasher according to claim 14 wherein said non-repeating oscillation positions are assumed for at least three successive turns.

16. The dishwasher according to claim 14 wherein said drive means produces oscillation of said spray arm at a frequency in which said frequency of oscillation is a noninteger multiple of said frequency of rotation of said spray arm about said central transverse axis.

17. The dishwasher according to claim 1 wherein said spray arm is located in the bottom region of the cabinet interior space of said dishwasher and wherein said jet spray means directs said jet spray of cleaning liquid generally upwardly into said cabinet interior space and wherein said drive means produces oscillation of said spray arm to direct said jet spray through vertical, forward and reverse inclination.

18. A dishwasher including:

a dishwasher cabinet having an interior space;

means for disposing dishware items within said interior space;

a spray arm;

means for supplying cleaning liquid under pressure to said spray arm and causing said liquid under pressure to be directed in jet sprays from said spray arm at said dishware items;

means for rotatably mounting said spray arm for rotation in said interior space;

means for producing rotation of said spray arm on said rotational mount;

means for causing said spray arm to assume differing positions during rotation thereof such that the angle of at least some of said jet sprays with respect to said dishware items differs in each rotational position of said spray arm during successive revolutions of said spray arm rotating about said rotational mount whereby shadowing of the jet sprays is reduced in each rotational position of said spray arm, said means including drive means for continuously oscillating said spray arm about an axis transverse to the axis of rotation thereof, at a frequency which is a non-integer multiple of the frequency of said rotation of said spray arm such that several oscillations of said spray arm take place for each revolution of said spray arm, and said position does not repeat for at least several revolutions.

19. A dishwasher comprising:

a dishwasher cabinet having an interior space;

means for positioning dishware items in said interior space;

means for directing a plurality of jet sprays of cleaning liquid at said dishware items positioned in said interior space, said means including:

an elongated spray arm;

means for mounting said elongated spray arm for rotation about an axis transverse to the longitudinal axis of said spray arm;

a plurality of jet nozzle means located along the length of said spray arm;

means for causing cleaning liquid under pressure to circulate into said spray arm and be directed outwardly through said plurality of jet nozzle means to direct said cleaning liquid in jet sprays at said dishware items;

means for continuously oscillating said spray arm about said longitudinal axis whenever said cleaning liquid is circulated into said spray arm to cause said jet sprays to be directed at varying angles with respect to said dishware items;

means for causing simultaneous continuous rotation of said spray arm about said central transverse axis, said means including reaction jet means located on either end of said spray arm, each of said reaction jet means including means for receiving said cleaning liquid under pressure and directing it outwardly in a jet spray, said jet spray being directed in a generally inclined angle with respect to said longitudinal axis measured in a plane normal to said longitudinal axis;

said respective reaction jet means on either end of said spray arm being directed in generally opposite directions measured in a plane normal to said longitudinal axis and producing an equal torque component tending to produce rotation of said spray arm when said spray arm is in a neutral position in said oscillation, and wherein said angle between said respective jet sprays measured in said plane normal to said longitudinal axis is at least as great as the angle through which said spray arm is oscillated and the said angle between said reaction jet means to jet sprays is less than 180°, thereby changing the inclination of said respective jet sprays caused by oscillation of said spray arm to produce offsetting changes in said respective torque components, whereby said torque acting on said spray arm remains substantially constant through said oscillations of said spray arm such that the spray arm rotates at a constant speed during said oscillation.

* * * * *

UNITED STATES PATENT AND TRADEMARK OFFICE

CERTIFICATE OF CORRECTION

PATENT NO. : 4,175,575
DATED : November 27, 1979
INVENTOR(S) : Donald S. Cushing It is certified that error appears in the above-identified patent and that said Letters Patent are hereby corrected as shown below:

Column 9, lines 19-20, delete -- said spray arm extending transversely to said hub axis and --.

Signed and Sealed this

*Eleventh* Day of *March 1980*

[SEAL]

*Attest:*

SIDNEY A. DIAMOND

*Attesting Officer*

*Commissioner of Patents and Trademarks*